US005830045A

United States Patent [19]

Togawa et al.

[11] Patent Number: 5,830,045

[45] Date of Patent: Nov. 3, 1998

[54] POLISHING APPARATUS

[75] Inventors: Tetsuji Togawa, Chigasaki; Kunihiko Sakurai, Yokohama; Ritsuo Kikuta, Ichikawa, all of Japan

[73] Assignee: Ebara Corporation, Tokyo, Japan

[21] Appl. No.: 697,167

[22] Filed: Aug. 20, 1996

[30] Foreign Application Priority Data

Aug. 21, 1995 [JP] Japan ..... 7-234663

[51] Int. Cl.[6] ..... B24B 7/22; B24B 51/00

[52] U.S. Cl. ..... 451/288; 451/67; 451/73; 451/5

[58] Field of Search ..... 451/66, 65, 41, 451/287, 288, 290, 5, 67, 73

[56] References Cited

U.S. PATENT DOCUMENTS

| | | | |
|---|---|---|---|
| 4,141,180 | 2/1979 | Gill, Jr. et al. . | |
| 4,680,893 | 7/1987 | Cronkhite et al. | 451/287 |
| 5,329,732 | 7/1994 | Karlsrud et al. | 451/289 |
| 5,468,302 | 11/1995 | Thietje | 134/1 |
| 5,616,063 | 4/1997 | Okumura et al. | 451/5 |
| 5,618,227 | 4/1997 | Tsutsumi et al. | 451/66 |
| 5,649,854 | 7/1997 | Gill, Jr. | 451/66 |
| 5,655,954 | 8/1997 | Oishi et al. | 451/67 |

FOREIGN PATENT DOCUMENTS

| | | | |
|---|---|---|---|
| 0 648 575 | 4/1995 | European Pat. Off. . | |
| 7132965 | 8/1982 | Japan | 451/288 |
| 4-334025 | 11/1992 | Japan . | |
| 2 056 169 | 3/1981 | United Kingdom . | |

*Primary Examiner*—Robert A. Rose
*Attorney, Agent, or Firm*—Wenderoth, Lind & Ponack, LLP

[57] ABSTRACT

A polishing apparatus polishes a workpiece such as a semiconductor wafer to a flat mirror finish. The polishing apparatus includes a storage cassette for storing workpieces to be polished, at least two polishing units each having at least a turntable with a polishing cloth mounted thereon and a top ring for supporting a workpiece and pressing the workpiece against the polishing cloth, and a cleaning unit for cleaning a workpiece which has been polished by either one of the polishing units in such a state that the workpiece is removed from the top ring. The polishing apparatus further includes a transfer robot for transferring a workpiece between two of the storage cassette, the polishing units and the cleaning unit.

25 Claims, 5 Drawing Sheets

POLISHING APPARATUS

BACKGROUND OF THE INVENTION

1. Field of the Invention

The present invention relates to a polishing apparatus, and more particularly to a polishing apparatus for polishing a workpiece such as a semiconductor wafer to a flat mirror finish.

2. Description of the Related Art

Recent rapid progress in semiconductor device integration demands smaller and smaller wiring patterns or interconnections and also narrower spaces between interconnections which connect active areas. One of the processes available for forming such interconnections is photolithography. Though the photolithographic process can form interconnections that are at most 0.5 $\mu$m wide, it requires that surfaces on which pattern images are to be focused by a stepper be as flat as possible because the depth of focus of the optical system is relatively small.

It is therefore necessary to make the surfaces of semiconductor wafers flat for photolithography. One customary way of flattening the surfaces of semiconductor wafers is to polish them by chemical mechanical polishing (CMP). Chemical mechanical polishing is performed by pressing a semiconductor wafer held by a carrier against a polishing cloth mounted on a turntable while supplying an abrasive liquid containing abrasive grains or material onto the polishing cloth.

For polishing a compound semiconductor or the like, two different abrasive liquids are supplied in two stages to polish the compound semiconductor. For example, U.S. Pat. No. 4,141,180 and Japanese laid-open patent publication No. 4-334025 disclose respective polishing apparatuses for polishing a compound semiconductor. Each of the disclosed polishing apparatuses has two turntables. A carrier which holds a semiconductor wafer is moved between the turntables, for polishing the semiconductor wafer by means of two-stage polishing comprising primary polishing and secondary polishing on the respective turntables and cleaning the semiconductor wafer between the two-stage polishing operation. In the cleaning process, the lower surface, which has been polished, of the semiconductor wafer is cleaned by water and/or a brush.

The conventional polishing apparatuses have suffered the following problems:

(1) Since the cleaning process which is carried out between primary polishing and secondary polishing is effected in such a state that the semiconductor wafer is being attached to the carrier, upper and side surfaces of the semiconductor wafer cannot be cleaned. The abrasive liquid containing abrasive grains which has been used in primary polishing and remained on the upper and side surfaces of the semiconductor wafer serves as a pollution source in secondary polishing, thus lowering the quality of the polished semiconductor wafer.

(2) In the polishing apparatus disclosed in U.S. Pat. No. 4,141,180, since the two turntables are positioned closely to each other, the abrasive liquid on one of the turntables reaches the other of the turntables and tends to contaminate the semiconductor wafer when it is polished on the other turntable.

(3) Some workpieces such as silicon wafers are not required to be polished by two-stage polishing. Since the polishing apparatus has only a single carrier in U.S. Pat. No. 4,141,180, both the turntables cannot be simultaneously operated for increasing the throughput of the workpieces that can be processed by the polishing apparatus. The polishing apparatus disclosed in Japanese laid-open patent publication No. 4-334025 has two carriers that move on the same rail between two of the turntables and the cleaning unit. Even if one of the carriers finishes a polishing operation, it has to wait until the other carrier finishes its polishing operation. Therefore, the efficiency of operation of the carriers is relatively low, adversely affecting the throughput and the quality of semiconductor wafers which have been polished.

SUMMARY OF THE INVENTION

It is therefore an object of the present invention to provide a polishing apparatus which can improve quality and yield of workpieces by preventing the workpiece from being contaminated with an abrasive liquid used in a previous polishing process in a multi-stage polishing operation such as two-stage polishing, and can polish workpieces simultaneously to increase throughput of the workpieces in a single-stage polishing operation.

According to the present invention, there is provided a polishing apparatus comprising storage means for storing workpieces to be polished; polishing means including at least two polishing units each having a turntable with a polishing cloth mounted thereon and a top ring for supporting a workpiece and pressing the workpiece against the polishing cloth; cleaning means for cleaning the workpiece which has been polished by either one of the polishing units, in such a state that the workpiece is removed from the top ring; and transfer means for transferring the workpiece between two of the storage means, the polishing means and the cleaning means.

The polishing apparatus may further comprise reversing means for reversing a workpiece before or after the workpiece is polished by either one of the polishing units. The cleaning means may comprise at least two cleaning units, and the reversing means may comprise at least two reversing units. The polishing units may be spaced from the storage means comprising a storage cassette in confronting relation thereto, and at least one of the cleaning units may be disposed on each side of a transfer line extending between the polishing units and the storage cassette. The polishing units may be spaced from the storage means comprising a storage cassette in confronting relation thereto, and at least one of the reversing units may be disposed on each side of a transfer line extending between the polishing units and the storage cassette.

According to the present invention, there is also provided a polishing apparatus comprising at least one storage cassette for storing workpieces to be polished; at least two polishing units each having a turntable with a polishing cloth mounted thereon and a top ring for supporting a workpiece and pressing the workpiece against the polishing cloth; at least one cleaning unit for cleaning the workpiece which has been polished by either one of the polishing units; and a transfer device for transferring the workpiece between two of the storage cassette, the polishing units and the cleaning unit.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

A first embodiment of the present invention will be described below with reference to FIGS. 1 through 3.

Figure 1:
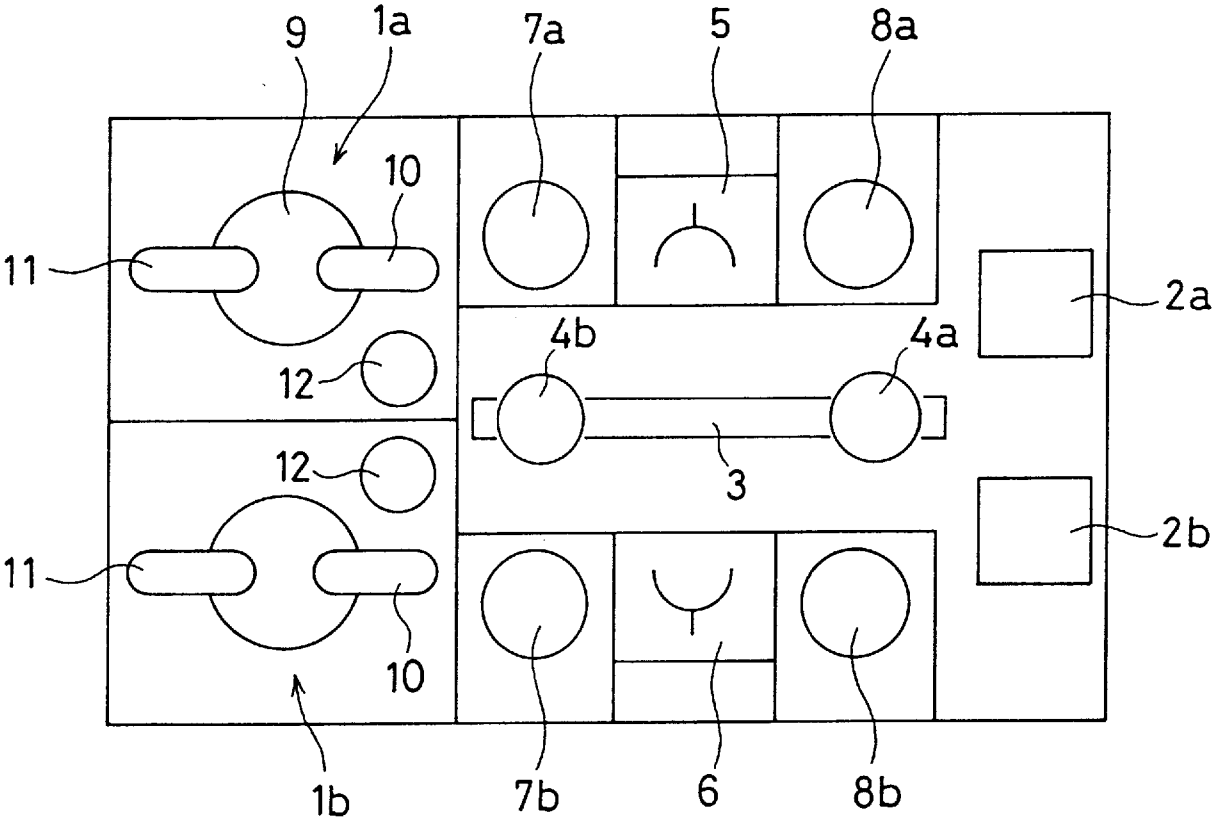
FIG. 1 is a schematic plan view of a polishing apparatus according to a first embodiment of the present invention.
Figure 2:
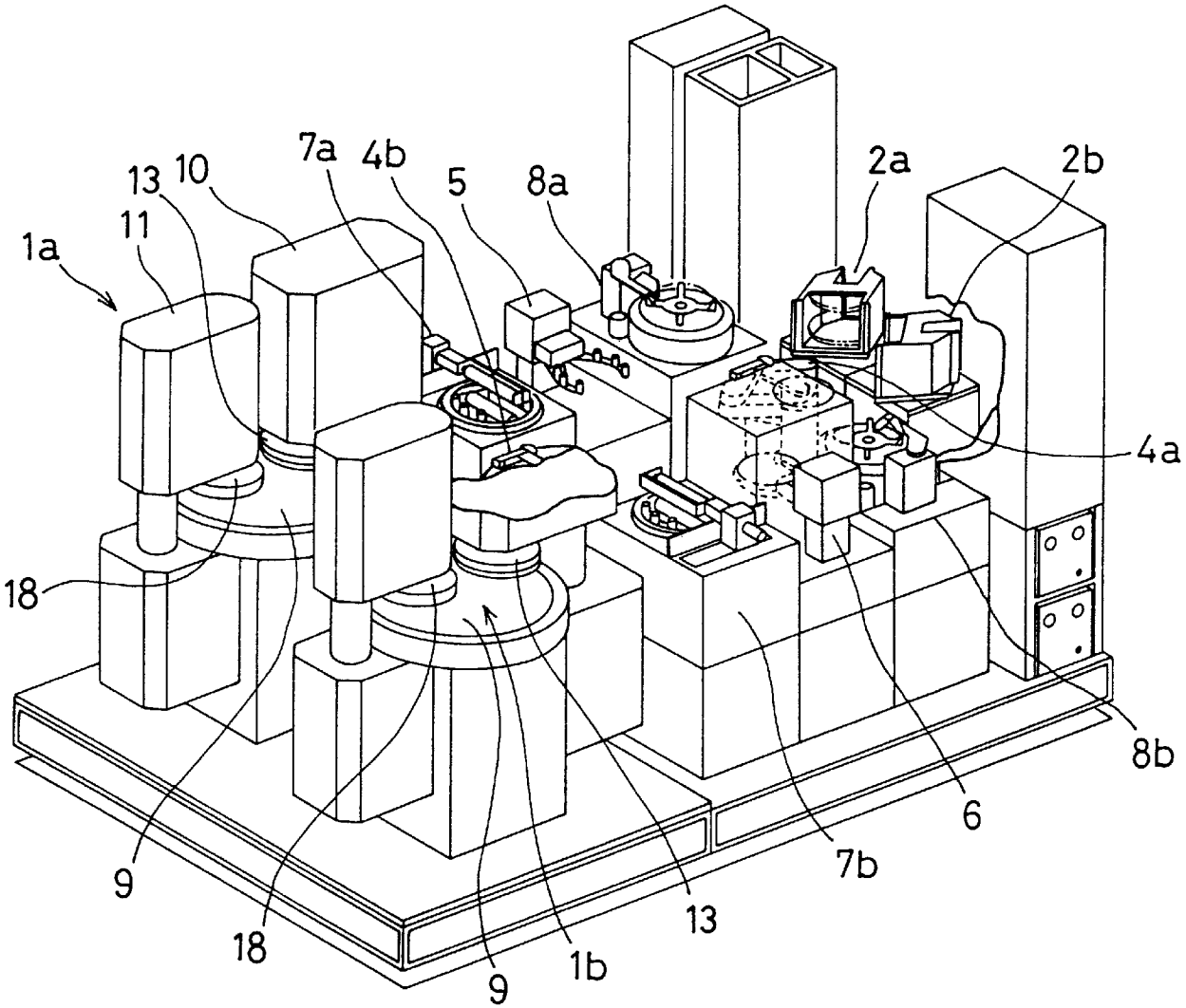
FIG. 2 is a perspective view of the polishing apparatus shown in FIG. 1.

As shown in FIGS. 1 and 2, a polishing apparatus comprises a pair of polishing units 1*a,* 1*b* positioned at one end of a rectangular floor space and spaced from each other in confronting relation to each other, and a pair of loading/unloading units positioned at the other end of the rectangular floor space and having respective wafer storage cassettes 2*a,* 2*b* spaced from the polishing units 1*a,* 1*b* in confronting relation thereto. Two transfer robots 4*a,* 4*b* are movably mounted on a rail 3 which extends between the polishing units 1*a,* 1*b* and the loading/unloading units, thereby providing a transfer line along the rail 3. The polishing apparatus also has a pair of reversing units 5, 6 disposed one on each side of the transfer line and two pairs of cleaning units 7*a,* 7*b* and 8*a,* 8*b* disposed one pair on each side of the transfer line. The reversing unit 5 is positioned between the cleaning units 7*a* and 8*a,* and the reversing unit 6 is positioned between the cleaning units 7*b* and 8*b*. Each of the reversing units 5, 6 serves to turn a semiconductor wafer over.

The polishing units 1*a* and 1*b* are of basically the same specifications, and are located symmetrically with respect to the transfer line. Each of the polishing units 1*a,* 1*b* comprises a turntable 9 with a polishing cloth attached to an upper surface thereof, a top ring head 10 for holding a semiconductor wafer under vacuum and pressing the semiconductor wafer against the polishing cloth on the upper surface of the turntable 9, and a dressing head 11 for dressing the polishing cloth.

Figure 3:
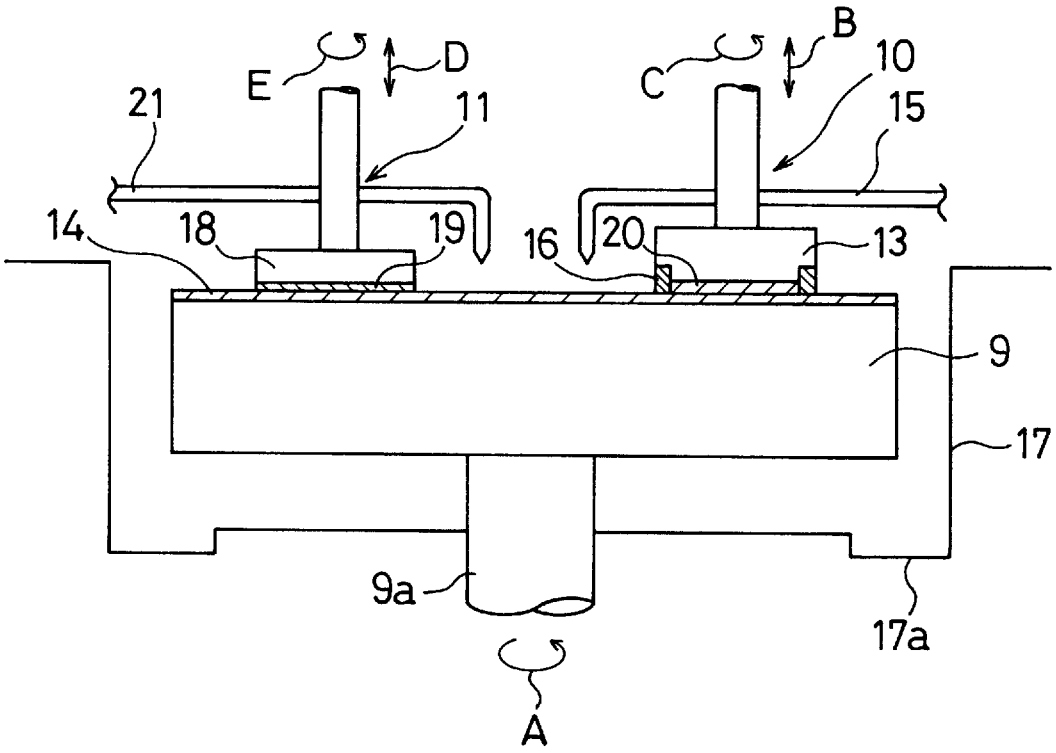
FIG. 3 is a vertical cross-sectional view of a polishing unit in the polishing apparatus according to the first embodiment of the present invention.

FIG. 3 shows a detailed structure of the polishing unit 1*a* or 1*b*.

As shown in FIG. 3, the top ring head 10 has a top ring 13 positioned above the turntable 9 for holding a semiconductor wafer 20 and pressing the semiconductor wafer 20 against the turntable 9. The top ring 13 is located in an off-center position with respect to the turntable 9. The turntable 9 is rotatable about its own axis as indicated by the arrow A by a motor (not shown) which is coupled through a shaft 9*a* to the turntable 9. A polishing cloth 14 is attached to an upper surface of the turntable 9.

The top ring 13 is coupled to a motor (not shown) and also to a lifting/lowering cylinder (not shown). The top ring 13 is vertically movable and rotatable about its own axis as indicated by the arrows B, C by the motor and the lifting/lowering cylinder. The top ring 13 can therefore press the semiconductor wafer 20 against the polishing cloth 14 under a desired pressure. The semiconductor wafer 20 is attached to a lower surface of the top ring 13 under a vacuum or the like. A guide ring 16 is mounted on the outer circumferential edge of the lower surface of the top ring 13 for preventing the semiconductor wafer 20 from being disengaged from the top ring 13.

An abrasive liquid supply nozzle 15 is disposed above the turntable 9 for supplying an abrasive liquid containing abrasive grains onto the polishing cloth 14 attached to the turntable 9. A frame 17 is disposed around the turntable 9 for collecting the abrasive liquid and water which are discharged from the turntable 9. The frame 17 has a gutter 17*a* formed at a lower portion thereof for draining the abrasive liquid and water that has been discharged from the turntable 9.

The dressing head 11 has a dressing member 18 for dressing the polishing cloth 14. The dressing member 18 is positioned above the turntable 9 in diametrically opposite relation to the top ring 13. The polishing cloth 14 is supplied with a dressing liquid such as water from a dressing liquid supply nozzle 21 extending over the turntable 9. The dressing member 18 is coupled to a motor (not shown) and also to a lifting/lowering cylinder (not shown). The dressing member 18 is vertically movable and rotatable about its own axis as indicated by the arrows D, E by the motor and the lifting/lowering cylinder.

The dressing member 18 is of a disk shape and holds a dressing element 19 on its lower surface. The lower surface of the dressing member 18, to which the dressing element 19 is attached, has holes (not shown) defined therein which are connected to a vacuum source for attaching the dressing element 19 under vacuum to the lower surface of the dressing member 18.

As shown in FIG. 1, each of the polishing units 1*a,* 1*b* also has a pusher 12 positioned near the transfer line 3 for transferring a semiconductor wafer 20 to and receiving a semiconductor wafer 20 from the top ring 13. The top ring 13 is swingable in a horizontal plane, and the pusher 12 is vertically movable.

The polishing unit 1*a* or 1*b* operates as follows:

The semiconductor wafer 20 is held on the lower surface of the top ring 13, and pressed against the polishing cloth 14 on the upper surface of the turntable 9. The turntable 9 and the top ring 13 are rotated relatively to each other for thereby bringing the lower surface of the semiconductor wafer 20 in sliding contact with the polishing cloth 14. At this time, the abrasive liquid nozzle 15 supplies the abrasive liquid to the polishing cloth 14. The lower surface of the semiconductor wafer 20 is now polished by a combination of a mechanical polishing action of abrasive grains in the abrasive liquid and a chemical polishing action of an alkaline solution in the abrasive liquid. The abrasive liquid which has been applied to polish the semiconductor wafer 20 is scattered outwardly off the turntable 9 into the frame 17 under centrifugal forces caused by the rotation of the turntable 9, and collected by the gutter 17*a* in the lower portion of the frame 17. The polishing process comes to an end when the semiconductor wafer 20 is polished by a predetermined thickness of a surface layer thereof. When the polishing process is finished, the polishing properties of the polishing cloth 14 are changed and the polishing performance of the polishing cloth 14 deteriorates. Therefore, the polishing cloth 14 is dressed to restore its polishing properties.

The polishing cloth 14 is dressed as follows:

While the dressing member 18 with the dressing element 19 held on its lower surface and the turntable 9 are being rotated, the dressing element 19 is pressed against the polishing cloth 14 to apply a predetermined pressure to the polishing cloth 14. At the same time that or before the dressing element 19 contacts the polishing cloth 14, a dressing liquid such as water is supplied from the dressing liquid supply nozzle 21 to the upper surface of the polishing cloth 14. The dressing liquid is supplied for the purposes of discharging an abrasive liquid and ground-off particles of the semiconductor wafer which remain on the polishing cloth 14 and removing frictional heat that is generated by the engagement between the dressing element 19 and the polishing cloth 14. The dressing liquid supplied to the polishing cloth 14 is then scattered outwardly off the turntable 9 into the frame 17 under centrifugal forces caused by the rotation of the turntable 9, and collected by the gutter 17*a* of the frame 17.

The cleaning units 7*a,* 7*b* and 8*a,* 8*b* may be of any desired types. For example, the cleaning units 7*a,* 7*b* which are positioned near the polishing units 1*a,* 1*b* may be of the type which scrubs both sides, i.e., face and reverse sides, of a semiconductor wafer with rollers having respective sponge layers, and the cleaning units 8*a,* 8*b* which are positioned near the wafer storage cassettes 2*a,* 2*b* may be of the type which supplies a cleaning solution to a semiconductor wafer that is being held at its edge and rotated in a horizontal plane. Each of the cleaning units 8*a,* 8*b* also serves as a drying unit for spin-drying a semiconductor wafer under centrifugal forces until it is dried. The cleaning units 7*a,* 7*b* can perform a primary cleaning of the semiconductor wafer, and the cleaning units 8*a,* 8*b* can perform a secondary cleaning of the semiconductor wafer which has been subjected to the primary cleaning.

Each of the transfer robots 4*a,* 4*b* has an articulated arm mounted on a carriage which is movable along the rail 3. The articulated arm is bendable in a horizontal plane. The articulated arm has, on each of upper and lower portions thereof, two grippers that can act as dry and wet fingers. The transfer robot 4*a* operates to cover a region ranging from the reversing units 5, 6 to the storage cassettes 2*a,* 2*b,* and the transfer robot 4*b* operates to cover a region ranging from the reversing units 5, 6 to the polishing units 1*a,* 1*b*.

The reversing units 5, 6 are required in the illustrated embodiment because of the storage cassettes 2*a,* 2*b* which store semiconductor wafers with their surfaces, which are to be polished or have been polished, facing upwardly. However, the reversing units 5, 6 may be dispensed with if semiconductor wafers are stored in the storage cassettes 2*a,* 2*b* with their surfaces, which are to be polished or have been polished, facing downwardly, and alternatively if the transfer robots 4*a,* 4*b* have a mechanism for reversing semiconductor wafers. In the illustrated embodiment, the reversing unit 5 serves to reverse a dry semiconductor wafer, and the reversing unit 6 serves to reverse a wet semiconductor wafer.

Figure 4A:
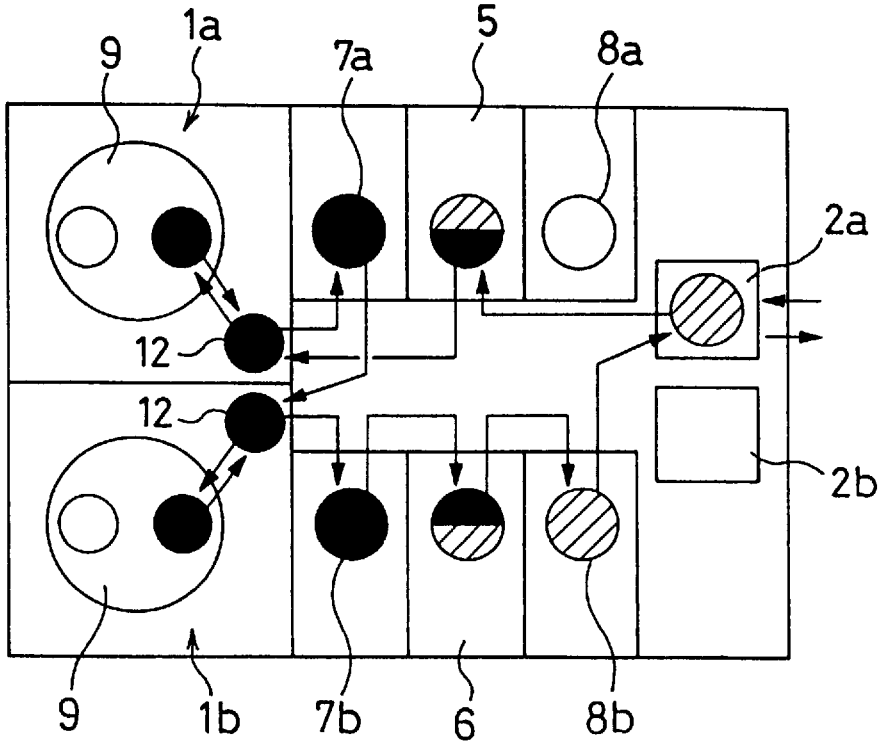
FIGS. 4A and 4B are schematic plan views illustrative of different modes of operation of the polishing apparatus shown in FIG. 1.
Figure 4B:
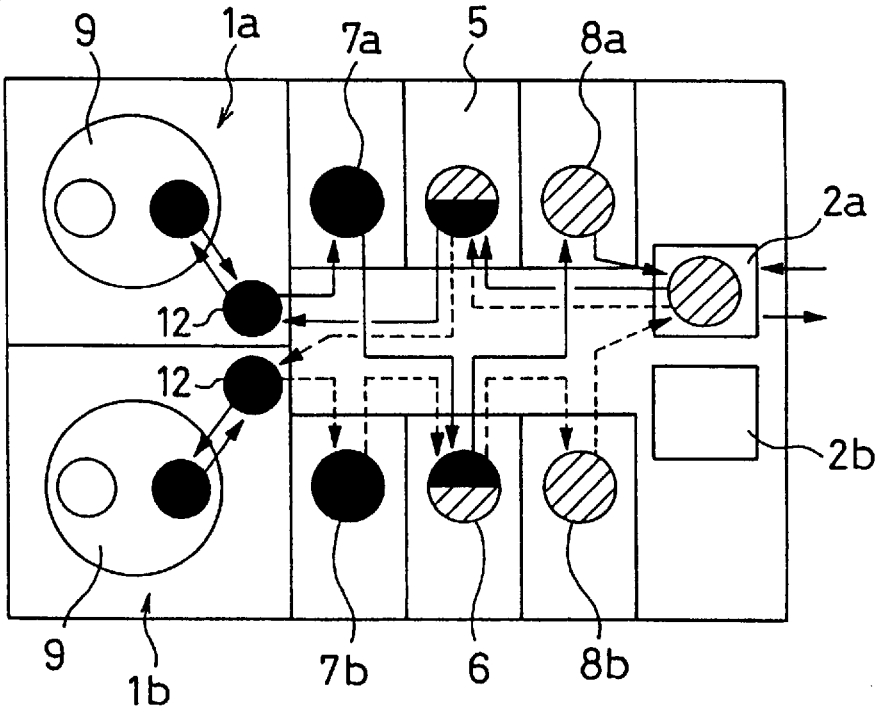

The polishing apparatus can be operated selectively in a series mode of polishing operation (hereinafter referred to as a serial processing) as shown in FIG. 4A and a parallel mode of polishing operation (hereinafter referred to as a parallel processing) as shown in FIG. 4B. The serial and parallel processings will be described below.

FIGS. 4A and 4B show the states of the semiconductor wafers in respective positions;  shows the position in which the semiconductor wafers are in the state of their surfaces, which are to be polished or have been polished, facing upwardly; ● shows the position in which the semiconductor wafers are in the state of their surfaces, which are to be polished or have been polished, facing downwardly;  shows the position in which the semiconductor wafers are in the state of their surfaces, which have been reversed and are to be polished, facing downwardly; and  shows the position in which the semiconductor wafers are in the state of their surfaces, which have been polished and reversed, facing upwardly.

(1) Serial Processing (FIG. 4A)

In the serial processing operation, a semiconductor wafer is polished by means of two-stage polishing, and three out of the four cleaning units 7*a,* 7*b,* 8*b* are operated to clean semiconductor wafers.

As shown by solid lines, a semiconductor wafer is transferred from the storage cassette 2*a* to the reversing unit 5. The semiconductor wafer is then transferred from the reversing unit 5 to the first polishing unit 1*a* after being reversed in the reversing unit 5. The semiconductor wafer is polished in the first polishing unit 1*a* and transferred therefrom to the cleaning unit 7*a* where it is cleaned. The cleaned semiconductor wafer is then transferred from the cleaning unit 7*a* to the second polishing unit 1*b* where it is polished. The semiconductor wafer is then transferred from the second polishing unit 1*b* to the cleaning unit 7*b* where it is cleaned. The cleaned semiconductor wafer is then transferred from the cleaning unit 7*b* to the reversing unit 6. The semiconductor wafer is then transferred from the reversing unit 6 to the cleaning unit 8*b* after being reversed in the reversing unit 6. The semiconductor wafer is then transferred from the cleaning unit 8*b* to the storage cassette 2*a* after being cleaned and dried in the cleaning unit 8*b*. The transfer robots 4*a,* 4*b* use the respective dry fingers when handling dry semiconductor wafers, and the respective wet fingers when handling wet semiconductor wafers. The pusher 12 of the polishing unit 1*a* receives the semiconductor wafer to be polished from the transfer robot 4*b,* is elevated and transfers the semiconductor wafer to the top ring 13 when the top ring 13 is positioned above the pusher 12. The semiconductor wafer which has been polished is rinsed by a rinsing liquid supplied from a rinsing liquid supply device which is provided at the pusher 12.

After the semiconductor wafer is applied subjected to a primary polishing operation in the polishing unit 1*a,* the semiconductor wafer is removed from the top ring 13 of the polishing unit 1*a,* and rinsed at the position of the pusher 12, and then cleaned in the cleaning unit 7*a*. Therefore, any abrasive liquid containing abrasive grains adhering to the polished surface, the reverse side of the polished surface, and side edge of the semiconductor wafer due to the primary polishing in the polishing unit 1*a* are completely removed. Then, the semiconductor wafer is subjected to a secondary polishing operation in the polishing unit 1*b,* and then is cleaned by the primary cleaning process of the cleaning unit 7*b* and the secondary cleaning process of the cleaning unit 8*b*. Thereafter, the polished and cleaned semiconductor wafer is spin-dried and returned to the storage cassette 2*a*. In the serial processing operation, polishing conditions of the primary polishing and secondary polishing are different from each other.

(2) Parallel Processing (FIG. 4B)

In the parallel processing operation, a semiconductor wafer is polished in a single polishing process. Two semiconductor wafers are simultaneously polished, and all the four cleaning units 7*a,* 7*b,* 8*a,* 8*b* are operated to clean semiconductor wafers. One or both of the storage cassettes 2*a,* 2*b* may be used. In the illustrated embodiment, only the storage cassette 2*a* is used, and there are two routes in which semiconductor wafers are processed.

In one of the routes, as shown by solid lines, a semiconductor wafer is transferred from the storage cassette 2*a* to the reversing unit 5. The semiconductor wafer is then transferred from the reversing unit 5 to the polishing unit 1*a* after being reversed in the reversing unit 5. The semiconductor wafer is polished in the polishing unit 1*a* and transferred therefrom to the cleaning unit 7*a* where it is cleaned. The cleaned semiconductor wafer is then transferred from the cleaning unit 7*a* to the reversing unit 6. The semiconductor wafer is then transferred from the reversing unit 6 to the cleaning unit 8*a* after being reversed in the reversing unit 6. Thereafter, the semiconductor wafer is transferred from the cleaning unit 8*a* to the storage cassette 2*a* after being cleaned and dried in the cleaning unit 8*a*.

In the other of the routes, as shown by broken lines, another semiconductor wafer is transferred from the storage cassette 2*a* to the reversing unit 5. The semiconductor wafer is then transferred from the reversing unit 5 to the polishing unit 1*b* after being reversed in the reversing unit 5. The semiconductor wafer is polished in the polishing unit 1*b* and transferred therefrom to the cleaning unit 7*b* where it is cleaned. The cleaned semiconductor wafer is then transferred from the cleaning unit 7*b* to the reversing unit 6. The semiconductor wafer is then transferred from the reversing unit 6 to the cleaning unit 8*b* after being reversed in the reversing unit 6. Thereafter, the semiconductor wafer is cleaned and dried in the cleaning unit 8*b,* and transferred to the storage cassette 2*a*. The transfer robots 4*a,* 4*b* use the respective dry fingers when handling dry semiconductor wafers, and the respective wet fingers when handling wet semiconductor wafers. The reversing unit 5 handles a dry semiconductor wafer, and the reversing unit 6 handles a wet semiconductor wafer in the same way as in serial processing operation. In the above parallel processing, the primary cleaning process is preformed by the cleaning units 7*a,* 7*b,* and the secondary cleaning process is preformed by the cleaning units 8*a,* 8*b*. For cleaning a semiconductor wafer, either one of the cleaning units 7*a,* 7*b* and either one of the cleaning units 8*a,* 8*b* may be used. In parallel processing, polishing conditions in the polishing units 1*a,* 1*b* may be the same, cleaning conditions in the cleaning units 7*a,* 7*b* may be the same, and cleaning conditions in the cleaning units 8*a,* 8*b* may be the same.

Figure 5:
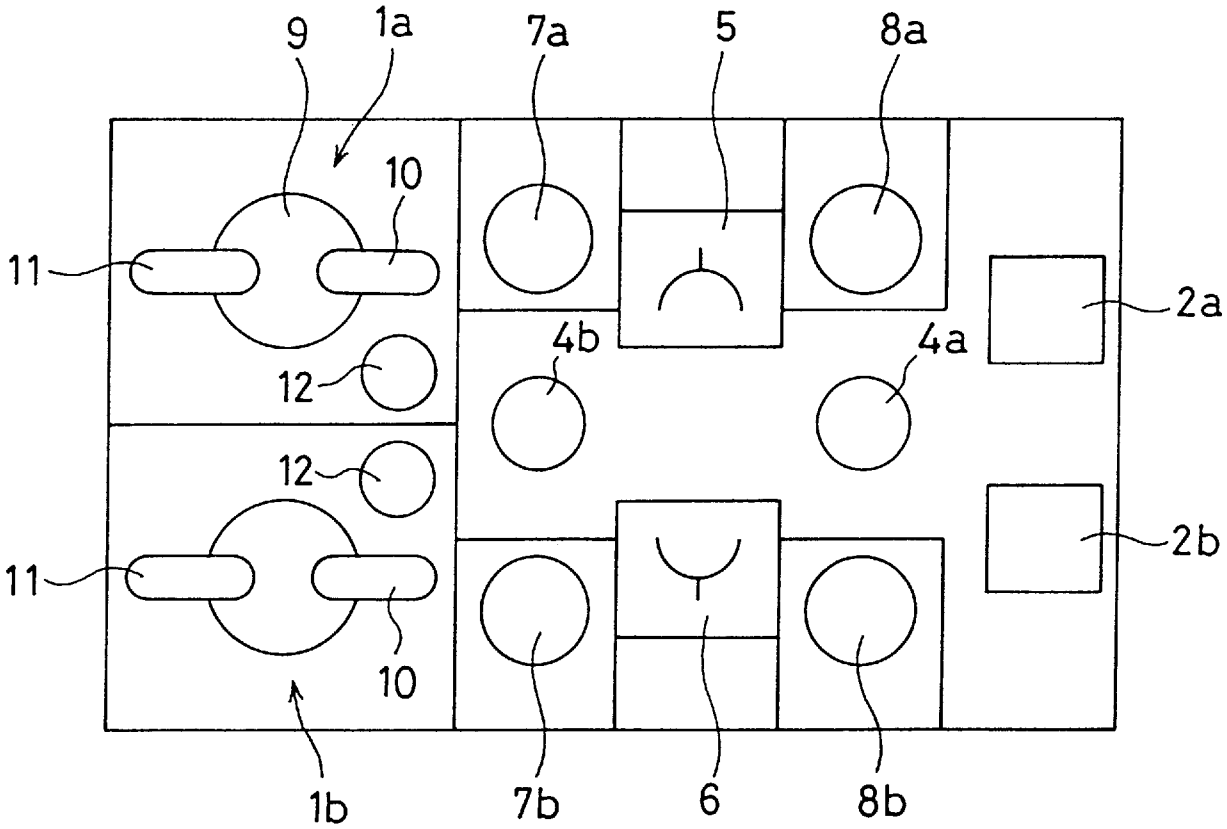
FIG. 5 is a schematic plan view of a polishing apparatus according to a second embodiment of the present invention.

FIG. 5 schematically shows in plan view a polishing apparatus according to a second embodiment of the present invention. The polishing apparatus according to the second embodiment differs from the polishing apparatus according to the first embodiment in that the transfer robots 4*a,* 4*b* do not move on a rail, but are fixedly installed in position. The polishing apparatus shown in FIG. 5 is suitable for use in applications where semiconductor wafers are not required to be transferred long distances, and is simpler in structure than the polishing apparatus shown in FIG. 1. In this embodiment, the transfer line also extends between the polishing units and the storage cassettes.

The number of cleaning units, the number of transfer robots, and the layout of these cleaning units and transfer robots may be modified. For example, if the polishing apparatus is not operated in parallel processing, then the polishing apparatus needs only three cleaning units. Whether the reversing units are to be used, the number, layout, and type of reversing units, the type of transfer robots, and whether the pushers are to be used may also be selected or changed as desired.

Example

Semiconductor wafers were actually polished by the polishing apparatus according to the present invention. In serial processing, the abrasive liquid applied by the polishing unit 1*a* was not carried over to the polishing unit 1*b,* thus causing no contamination to the semiconductor wafers.

The wafer processing efficiencies, i.e., the throughputs (the number of processed wafers/hour) of a comparative polishing apparatus and the inventive polishing apparatus in both serial and parallel processing operations are shown in Table given below:

TABLE

TT: turntable

| | Throughputs (the number of processed wafers/hour) | | |
|---|---|---|---|
| | 1TT comparative | 2TT serial | 2TT parallel |
| processing time (seconds) per one wafer (1st TT/2nd TT) | 120/— | 120/60 | 120/120 |
| 1TT (comparative) | 19 | | |
| 2TT (serial processing) | | 19 | |
| 2TT (parallel processing) | | | 38 |

The comparative polishing apparatus employed one turntable, a required number of cleaning units, a required number of reversing units, and a required number of transfer robots. In serial and parallel processing, two turntables and two top rings are employed. As can be seen from Table above, the inventive polishing apparatus used in parallel processing has a throughput per turntable which is comparable to that of the comparative polishing apparatus. Therefore, the inventive polishing apparatus used in parallel processing has a greatly increased wafer processing capability per floor space.

As is apparent from the above description, according to the present invention, the polishing apparatus can improve quality and yield of workpieces by preventing the workpiece from being contaminated with an abrasive liquid used in a previous polishing operation process in a multi-stage polishing such as a two-stage polishing, and can polish workpieces simultaneously to increase throughput of the workpieces in a single-stage polishing.

Further, according to the present invention, serial processing in which a two-stage polishing is performed and parallel processing in which a single-stage polishing is performed can be freely selected.

In the illustrated embodiments, although the top ring supports only one semiconductor wafer, the top ring may support a plurality of semiconductor wafers simultaneously. A plurality of top rings may be provided in each polishing unit.

Although certain preferred embodiments of the present invention have been shown and described in detail, it should be understood that various changes and modifications may be made therein without departing from the scope of the appended claims.

What is claimed is:

1. A polishing apparatus for polishing workpieces and capable of use for simultaneous parallel single-stage polishing of plural workpieces or of use for series multi-stage polishing of workpieces, said apparatus comprising:

a storage means for storing workpieces to be polished and polished workpieces;

two polishing units for polishing the workpieces, said two polishing units being spaced from said storage means by a transfer line therebetween, said two polishing units being juxtaposed and positioned on opposite sides of said transfer line;

four cleaning units for cleaning the workpieces, said cleaning units being arranged in two pairs, a first said pair being positioned adjacent said polishing units and spaced from said storage means and including first and second said cleaning units positioned on opposite sides of said transfer line, and a second said pair being positioned adjacent said storage means and spaced from said polishing units and including third and fourth said cleaning units positioned on opposite sides of said transfer lines; and a transfer system positioned between said storage means and said polishing units for transferring workpieces from said storage means to at least one said polishing unit and at least two said cleaning units and back to said storage means.

2. A polishing apparatus as claimed in claim 1, wherein said transfer system is positioned along said transfer line.

3. A polishing apparatus as claimed in claim 2, wherein said transfer system comprises two transfer robots, a first said transfer robot being positioned adjacent said storage means and spaced from said polishing units, and a second said transfer robot being positioned adjacent said polishing units and spaced from said storage means.

4. A polishing apparatus as claimed in claim 3, wherein a first said transfer robot is operable to handle dry workpieces, and a second said transfer robot is operable to handle wet workpieces.

5. A polishing apparatus as claimed in claim 3, wherein said transfer line comprises a rail, and said transfer robots are movable along said rail.

6. A polishing apparatus as claimed in claim 1, wherein said transfer line comprises a rail, and said transfer system is movable along said rail.

7. A polishing apparatus as claimed in claim 1, wherein said transfer system includes a first manipulator for handling dry workpieces and a second manipulator for handling wet workpieces.

8. A polishing apparatus as claimed in claim 1, further comprising two reversing units for reversing the workpieces either before or after polishing thereof by at least one of said polishing units, said reversing units being positioned on opposite sides of said transfer line.

9. A polishing apparatus as claimed in claim 8, wherein said reversing units are positioned between said first and second pairs of cleaning units.

10. A polishing apparatus as claimed in claim 8, wherein a first said reversing unit is operable to handle dry workpieces, and a second said reversing unit is operable to handle wet workpieces.

11. A polishing apparatus as claimed in claim 1, wherein said storage means comprises at least one storage cassette.

12. A polishing apparatus as claimed in claim 1, wherein said storage means comprises two storage cassettes.

13. A polishing apparatus as claimed in claim 1, wherein each said polishing unit includes a pusher member for positioning of a workpiece to be transferred to or from said polishing unit, said pusher member including a rinsing liquid supply device.

14. A polishing apparatus for polishing workpieces, said apparatus comprising:

a storage means for storing workpieces to be polished and polished workpieces;

two polishing units for polishing the workpieces, said two polishing units being spaced from said storage means by a transfer line therebetween, said two polishing units being juxtaposed and positioned on opposite sides of said transfer line;

three cleaning units for cleaning the workpieces, first and second said cleaning units being positioned on one side of said transfer line, and a third said cleaning unit being positioned on an opposite side of said transfer line; and a transfer system positioned between said storage means and said polishing units for transferring workpieces from said storage means to said polishing units and said cleaning units.

15. A polishing apparatus as claimed in claim 14, wherein said transfer system is positioned along said transfer line.

16. A polishing apparatus as claimed in claim 15, wherein said transfer system comprises two transfer robots, a first said transfer robot being positioned adjacent said storage means and spaced from said polishing units, and a second said transfer robot being positioned adjacent said polishing units and spaced from said storage means.

17. A polishing apparatus as claimed in claim 16, wherein a first said transfer robot is operable to handle dry workpieces, and a second said transfer robot is operable to handle wet workpieces.

18. A polishing apparatus as claimed in claim 16, wherein said transfer line comprises a rail, and said transfer robots are movable along said rail.

19. A polishing apparatus as claimed in claim 14, wherein said transfer line comprises a rail, and said transfer system is movable along said rail.

20. A polishing apparatus as claimed in claim 14, wherein said transfer system includes a first manipulator for handling dry workpieces and a second manipulator for handling wet workpieces.

21. A polishing apparatus as claimed in claim 14, further comprising two reversing units for reversing the workpieces either before or after polishing thereof by at least one of said polishing units, said reversing units being positioned on opposite sides of said transfer line.

22. A polishing apparatus as claimed in claim 21, wherein a first said reversing unit is operable to handle dry workpieces, and a second said reversing unit is operable to handle wet workpieces.

23. A polishing apparatus as claimed in claim 14, wherein said storage means comprises at least one storage cassette.

24. A polishing apparatus as claimed in claim 14, wherein said storage means comprises two storage cassettes.

25. A polishing apparatus as claimed in claim 14, wherein each said polishing unit includes a pusher member for positioning of a workpiece to be transferred to or from said polishing unit, said pusher member including a rinsing liquid supply device.

* * * * *